US008844186B2

(12) United States Patent
Leclair

(10) Patent No.: US 8,844,186 B2
(45) Date of Patent: Sep. 30, 2014

(54) FIREARM HAND GUARD

(75) Inventor: Lamonte L. Leclair, Coronado, CA (US)

(73) Assignee: Centurion Arms, LLC, Morgantown, IN (US)

( * ) Notice: Subject to any disclaimer, the term of this patent is extended or adjusted under 35 U.S.C. 154(b) by 0 days.

(21) Appl. No.: 13/297,222

(22) Filed: Nov. 15, 2011

(65) Prior Publication Data

US 2012/0124880 A1 May 24, 2012

Related U.S. Application Data

(60) Provisional application No. 61/415,231, filed on Nov. 18, 2010.

(51) Int. Cl.

| | |
|---|---|
| ***F41A 21/00*** | (2006.01) |
| ***F41C 23/16*** | (2006.01) |
| ***F41A 21/48*** | (2006.01) |

(52) U.S. Cl.

CPC ..... *F41C 23/16* (2013.01); *F41A 21/484* (2013.01)

USPC ..... 42/75.01; 42/71.01; 42/72

(58) Field of Classification Search

CPC ..... F41A 21/484; F41C 23/16

USPC ..... 42/75.01, 71.01, 72

See application file for complete search history.

(56) References Cited

U.S. PATENT DOCUMENTS

| | | | | |
|---|---|---|---|---|
| 3,090,150 | A * | 5/1963 | Stoner | 42/71.01 |
| 6,216,451 | B1 * | 4/2001 | Schnaibel et al. | 60/277 |
| 6,490,822 | B1 * | 12/2002 | Swan | 42/71.01 |
| 6,671,990 | B1 * | 1/2004 | Booth | 42/75.01 |
| 6,694,660 | B1 * | 2/2004 | Davies | 42/75.01 |
| RE39,465 | E * | 1/2007 | Swan | 42/71.01 |
| 7,216,451 | B1 * | 5/2007 | Troy | 42/72 |
| 7,707,762 | B1 * | 5/2010 | Swan | 42/85 |
| 7,716,865 | B2 * | 5/2010 | Daniel et al. | 42/75.02 |
| 7,793,452 | B1 * | 9/2010 | Samson et al. | 42/72 |
| 7,941,959 | B1 * | 5/2011 | Swan | 42/85 |
| 8,037,633 | B1 * | 10/2011 | Troy | 42/71.01 |
| 8,141,289 | B2 * | 3/2012 | Gomez et al. | 42/90 |
| 8,201,353 | B1 * | 6/2012 | Swan | 42/71.01 |
| 2007/0017139 | A1 * | 1/2007 | Larue | 42/75.1 |
| 2007/0033851 | A1 * | 2/2007 | Hochstrate et al. | 42/75.01 |
| 2010/0095575 | A1 * | 4/2010 | Swan | 42/72 |
| 2010/0175293 | A1 * | 7/2010 | Hines | 42/71.01 |
| 2010/0269392 | A1 * | 10/2010 | Swan | 42/71.01 |
| 2011/0061281 | A1 * | 3/2011 | Kapusta et al. | 42/71.01 |
| 2011/0239513 | A1 * | 10/2011 | Sandman | 42/90 |
| 2012/0042557 | A1 * | 2/2012 | Gomez et al. | 42/90 |

* cited by examiner

*Primary Examiner* — Michelle R Clement

(74) *Attorney, Agent, or Firm* — Gary L. Loomis; G.L. Loomis & Associates, Inc.

(57) ABSTRACT

The present invention describes a firearm hand guard assembly attachable to a firearm upper receiver and surrounding the firearm barrel distally along the longitudinal axis without touching the barrel. The hand guard assembly is comprised of an upper component and a lower component such that when the upper component and lower component are attached to one another with a firearm disposed therein, the sole contact between the firearm and the hand guard assembly is the contact between the firearm barrel nut and the inner surfaces of the proximal end of the hand guard assembly.

6 Claims, 6 Drawing Sheets

FIREARM HAND GUARD

CROSS-REFERENCE TO RELATED APPLICATION

This application claims priority under 35 U.S.C. §119(e) to U.S. Provisional Application No. 61/415,231 filed Nov. 18, 2010, which is herein incorporated by reference.

FIELD OF THE INVENTION

The invention relates to a modular hand guard for use on a firearm.

BACKGROUND OF THE INVENTION

Hand-held firearms usually require some type of hand guard or handgrip so that the operator can safely hold the firearm as it is fired. The hand guards currently available in the firearms industry have inherent design problems. Many firearms are operated in automatic or semiautomatic modes and have a tendency to heat extensively so that hand guards attached directly to the barrel can produce hand burns to the operator. The heat generated by the firearm barrel transfers directly to any components it contacts, thereby directly transferring heat sufficient to burn hands as well as to impair or destroy attached electrical devices. Further compounding this problem is the requirement that gun barrels be extra heavy to support the added weight attached by means of the collars. This in turn means more cantilevered stress on the barrel where it is joined with the firearm's aluminum receiver. The combination of heat and barrel weight tend to pull the barrel chamber out of alignment with the bolt lead, thereby causing bolt lug and extractor failure. In addition, anything attached directly to the barrel of a firearm can have a tendency to alter the barrel slightly and any alterations can adversely affect the accuracy of the firearm.

U.S. Pat. No. 6,490,822 and RE39,465 to Swan describe a handgrip or hand guard in the form of a receiver sleeve attached to the top of a firearm upper receiver wherein the sleeve has an upper hand guard piece attached thereto and a bottom hand guard piece fitted about the bottom of the gun barrel and is attached to the upper hand guard piece. Such a configuration additionally requires a special U-shaped supporting yoke inserted about and secured to the barrel nut at the rearward end of the upper hand guard piece to which the modular sleeve is attached. However, due to U-shape design of the yoke the U-shaped yoke can only engage a portion of the barrel nut and therefore may not provide adequate support for hand guard components which will be supported from the yoke and barrel nut combination. Therefore, in these instances, this style hand guard may not suitably protect or aid a user of the firearm.

U.S. Pat. No. 7,216,451 and published United States Patent Application 2007/0261285 to Troy describes a modular hand grip for use on a firearm that includes an upper portion, a lower portion and a coupling assembly wherein a plurality of lug rails having a plurality of gaps therein project from an inner surface of the upper portion at opposing sides and proximate edges thereof, wherein the lugs can engage in the gaps in the lug rails of the lower portion.

U.S. Pat. Nos. 6,490,822, RE 39,465, 7,216,451 and published United States Patent Application 2007/0261285 are both hereby included by way of reference.

In view of the foregoing disadvantages inherent in the known types of devices now present in the prior art, the present invention provides a hand guard in the form of an easily attachable dual component receiver sleeve. As such, the general purpose of the present invention, which will be described subsequently in greater detail, is to provide a new and improved interface means for firearms which will isolate the barrel while providing various capabilities for mounting and integrating optics, lasers, sensors and the like.

Therefore, a need exists for systems and methods for providing a hand guard and accessory attachment device for a firearm, for example, a rifle.

The present invention addresses problems and deficiencies inherent in the hand guards of the art and presents improvements.

Accordingly, it is an object the present invention to provide a new and improved hand guard for a firearm.

Another object of the present invention is to provide a hand guard, which is not directly attached to the barrel of a firearm.

Another object of the present invention is to provide a hand guard, which can be utilized with existing firearms, and specifically those with conventional barrel nuts.

Another object of the present invention is to provide a hand guard, which is easily attached to existing firearms, and specifically those with conventional barrel nuts.

Yet another object of the present invention is to provide a hand guard, which imparts increases stability when attached to the barrel of a firearm.

These and other objects of the present invention will be apparent from a review of the following specification and accompanying drawings.

SUMMARY OF THE INVENTION

Figure 1:
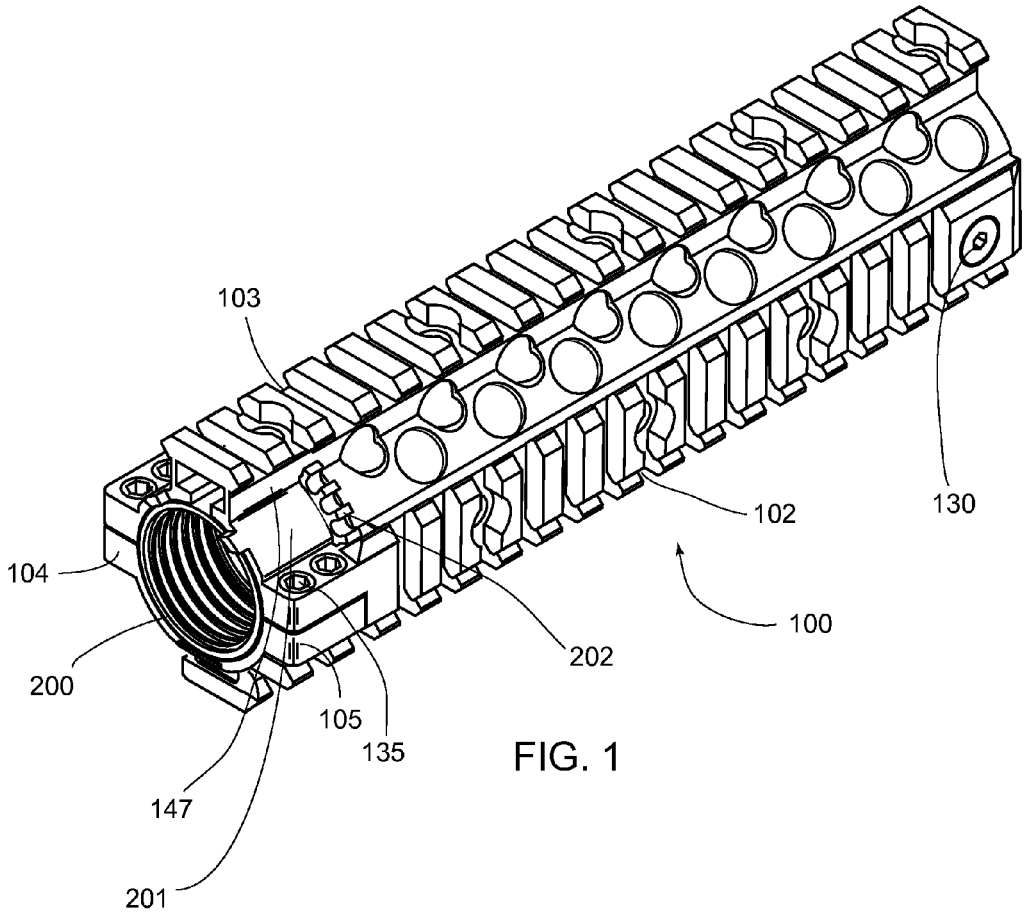
FIG. 1 is an isometric view from the proximal end of an assembled hand guard of the present invention wherein the proximal end has a typical barrel nut engaged therein.

The present invention describes firearm hand guard attachable to a firearm upper receiver and extending around the firearm barrel distally to a position just short of the barrel front sight. The hand guard is comprised of an upper component and a lower component wherein the upper component and lower components are configured to be engageable to provide a hand guard having a lumen that surrounds the barrel of and is affixed to a firearm. The luminal surfaces of proximal ends of the upper and lower components are configured respectively to engage and retain the barrel nut of a firearm Furthermore, the proximal ends of the upper and lower components each comprise a mated flange via which the upper and lower components can be coupled thereby retaining the barrel nut and therefore affixing the hand guard to the firearm. In certain embodiments the flanges are configured to define apertures configured to accommodate fastening devices such as bolts or screws by which the upper and lower components are securable to on another, while exerting sufficient force on the barrel nut to affix the hand guard to the firearm. In certain preferred embodiments the apertures are threaded to accept suitably configured bolts. The proximal end of the lower component comprises two diametrically disposed tabs configured to fit into two diametrically disposed slots in the proximal end of the upper component. In certain embodiments the tabs and the slots are configured to define slot apertures and tab apertures configured to accommodate fastening devices such as bolts or screws by which the upper and lower components are securable to on another when the tabs are engaged in the slots. In certain embodiments the slot apertures extend completely thorough the wall of the slot and the tab apertures also extend completely through the thickness of the tabs. In other embodiments the tab apertures extend into but not completely through the thickness of the tab. In certain preferred embodiments the tab apertures and slot apertures are threaded to mate with suitably configured bolts.

The proximal ends of the both upper component and lower component of the hand guard assembly comprises a groove situated perpendicular to the longitudinal axis of the hand guard configured to accept the raised, commonly serrated, ring disposed around the periphery of a standard barrel nut. A bottom hand guard component is fitted about the bottom of the gun barrel and is attached to the upper hand guard component. The hand guard is not physically connected in any way to the gun barrel and is self-supported solely by the connection of the barrel nut. Certain embodiments also comprise one or more rails for attaching or incorporating ancillary equipment. The upper and lower components of the hand guard are affixed to on another by attachment means including, but not limited to screws, nuts, bolts and the like. In certain preferred embodiments the attachment means are screws mated to threaded apertures in the upper and/or lower components.

DETAILED DESCRIPTION

For purposes of the present invention:

- the terms "handgrip" and "hand guard" are synonymous.
- the term distal end refers to the direction toward a muzzle of firearm and the term proximal end refers to the direction toward a receiver of a firearm; and
- the term upper component refers to the component of the hand guard the resides on the topside of a firearm oriented in a normal firing position and the term lower component refers to the component of the hand guard the resides on the bottom side of a firearm oriented in a normal firing position.
- the term "typical barrel nut" refers to an internally threaded barrel nut having a radially outwardly directed serrated rim having tines spaced about the outer periphery, wherein the barrel nut is configured to be threadedly secured to the receiver of a firearm. Such a "typical barrel nut" also known as a standard barrel nut is well known in the art and is readily commercially available.

Embodiments of the present invention disclose a hand guard or handgrip for a firearm, wherein the firearm has minimally a receiver with a stock and barrel attached 185 thereto, said barrel defining the forward or distal portion of the firearm and said stock defining the rearward or proximal portion of the firearm. Such a firearm has a longitudinal axis being defined as horizontal and extending distally from the firearm stock. The receiver has a distal end and a proximal end, wherein the receiver proximal end is attached to the stock and the receiver distal end is connected to the barrel by means of a barrel nut.

Preferred embodiments of the hand guard comprise an upper hand guard component and a lower hand guard component, the define a generally tubular sleeve that is configured to encircle the firearm barrel along the longitudinal barrel axis from the firearm upper receiver to a position just short of the firearm barrel front sight. In such embodiments the hand guard is attached only to the firearm barrel nut and is self-supported by this connection to the barrel nut. When such a hand guard is properly attached to the firearm barrel nut, the hand guard encircles the barrel and there is no other physical communication of the hand guard with the gun barrel. Such embodiments differ significantly from those of the prior art in that with the hand guard of the present invention provides direct contact of with both the upper and lower components with the barrel nut, which acts to secure the hand guard to the firearm.

Certain preferred embodiments provide hand guard assembly reversibly attachable to a firearm, the firearm having a receiver, a barrel and a barrel nut affixing the barrel to the receiver, the barrel nut having a the smooth circular outer surface and radially outwardly directed serrated rim about the outer periphery, wherein the hand guard assembly has an upper component comprising an upper component wall, an upper component proximal end, an upper component distal end, an upper component outer surface, an upper component inner surface and two parallel upper component edges; wherein the upper component is configured and sized to mate with and be affixed to a lower component comprising a lower component wall, a lower component proximal end, a lower component distal end, a lower component outer surface, a lower component inner surface, and two parallel lower component edges. In such an embodiment the upper component inner surface at the upper component proximal end and the lower component inner surface at the lower component proximal end are each configured and sized to define a smooth concave semicircular surface disposed between the two parallel upper component edges and the two parallel lower component edges respectively such that when the upper component and lower component are mated, the smooth concave semicircular surfaces provide intimate contact with the smooth circular outer surface of a barrel nut on a firearm disposed therein. Also in such embodiments the upper component inner surface at the upper component proximal end further comprises an upper component groove configured and sized to accommodate the radially outwardly directed serrated rim of a barrel nut on a firearm disposed therein; and the lower component inner surface at the lower component proximal end further comprises a lower component groove configured and sized to accommodate the radially outwardly directed serrated rim of a barrel nut on a firearm disposed therein. Further more in such an embodiments the two upper component edges at the proximal end further comprise two upper component flanges and the two lower component edges at the proximal end further comprise two lower component flanges configured and sized to mate with the two upper component flanges and the lower component and upper component flanges comprise means to attach and secure the upper component flanges to the lower component flanges and the two upper component edges at the proximal end each comprise an upper component slot and two lower component edges at the proximal end each comprise a tab configured and sized to mate with the upper component slots and the upper component slots and lower component tabs comprise means to attach and secure the lower component tabs within the upper component slots. In these preferred embodiments when the upper component and lower component are attached with a firearm disposed therein, the sole contact between the firearm and the hand guard assembly is the contact between the barrel nut and the inner surfaces and grooves of the proximal ends of the upper and lower components and that the hand guard surrounds the barrel of a firearm disposed therein along the longitudinal axis without touching the barrel.

In certain embodiments of the hand guard assembly as described above the means to attach and secure the upper component flanges to the lower component flanges comprise one or more threaded apertures in each of the upper component flanges mated to one or more threaded apertures in each of the lower and one or more attachment bolts mated to the threaded flange apertures. While in certain of such embodiments the means to attach and secure the lower component tabs within the upper component slots comprise one or more threaded apertures in each of the lower component tabs mated to one or more threaded apertures in each of the upper component slots and one or more attachment bolts mated to the threaded tab and threaded slot apertures.

In certain embodiments of hand guard assembly of the present invention the upper component comprises a plurality of upper component apertures extending though the upper component wall and some embodiments the lower component comprises a plurality of lower component apertures extending though the lower component wall. and in certain preferred embodiments both the upper and lower components comprises a plurality apertures extending though the component walls.

In certain preferred embodiments of the hand guard assembly of claim the upper component comprises one or more upper component rails extending along the hand guard longitudinal axis and configured to provide a means for attachment of auxiliary firearm elements.

Figure 2:
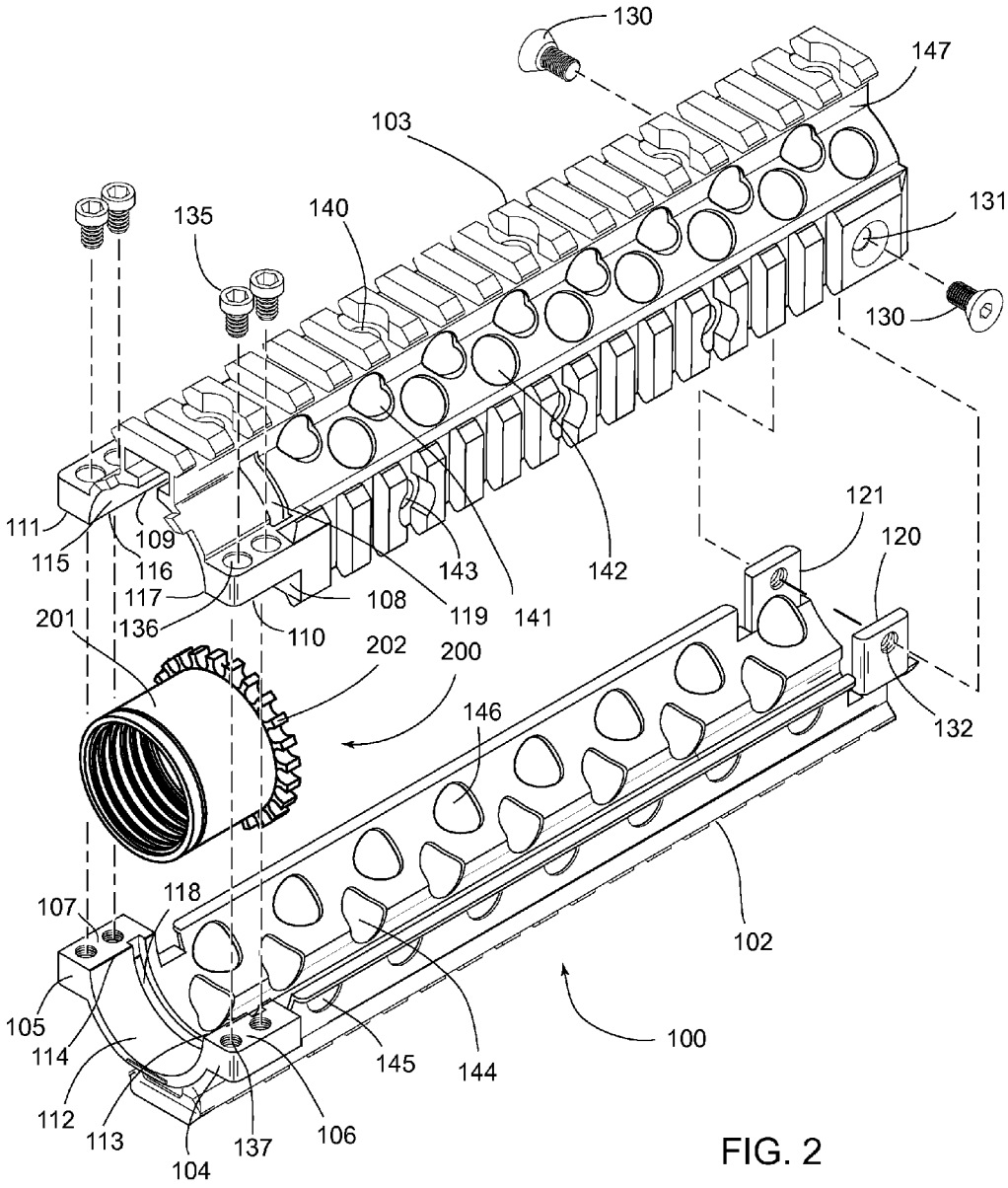
FIG. 2 is an exploded isometric view from the proximal end of a hand guard of FIG. 1.
Figure 3:
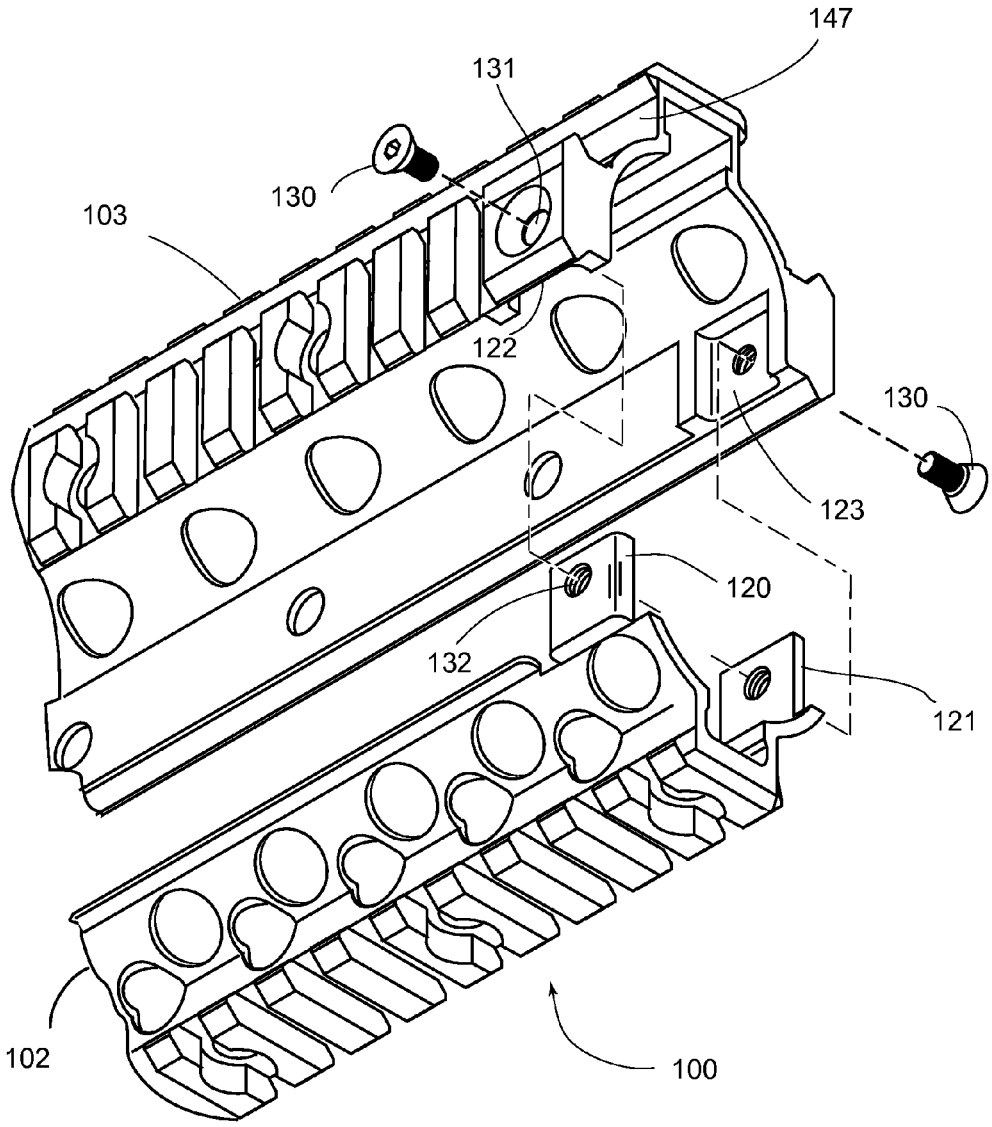
FIG. 3 is an exploded partial isometric view from the distal end of the hand guard of FIGS. 1 and 2.

In FIG. 1 is presented an isometric view of an embodiment of a hand guard 100 of the present invention coupled to a typical firearm barrel nut 200 and in FIG. 2 is presented an exploded isometric view of the hand guard 100 of FIG. 1. Such a typical barrel nut 200 is internally threaded such that it is threadedly attachable to an externally threaded firearm component (see FIG. 15). The hand guard 100 comprises an upper hand guard component 103 and a lower hand guard component 102 each having a proximal end and a distal end. The proximal end of lower hand guard component 102 is configured to define two flanges 104 and 105 disposed diametrically relative to the longitudinal axis of hand guard 100 and wherein the flanges 104 and 105 have parallel smooth flat surfaces 106 and 107 respectively. The proximal end of the upper hand guard component 103 comprises L-shaped flanges 108 and 109 disposed diametrically relative to the longitudinal axis of hand guard 100, wherein the I-shaped flanges 108 and 109 have parallel flat surfaces 110 and 111 respectively that precisely mate with the flat surfaces 106 and 107 of flanges 104 and 105 of the lower hand guard component 102. The proximal end of lower hand guard component 102 is further configured and dimensioned to define a semicircular smooth surface 112 disposed between the edges 113 and 114 of the parallel smooth flat surfaces 106 and 107 of flanges 104 and 105 respectively; and the proximal end of upper hand guard component 103 is further configured and dimensioned to define a smooth semicircular surface 115 disposed between the edges 116 and 117 of the parallel flat surfaces 110 and 111 of L-shaped notches 108 and 109 respectively. When the hand guard is assembled the semicircular cavities 112 and 115 define a circular opening configured and dimensioned to mate with and provide intimate contact with the smooth outer surface 201 of the barrel nut 200 disposed therein and thereby securely coupling the hand guard 100 to the barrel nut 200. The semicircular cavities 112 and 115 each further comprise a groove 118 and 119 respectively, wherein the grooves 118 and 119 are in a plane perpendicular to the longitudinal axis of the hand guard 100 and are configured and dimensioned to accept and provide intimate contact with the gear-like serrated rim 202 disposed around the distal end of barrel nut 200. When the hand guard 100 is assembled and attached to the barrel nut 200, the grooves groove 118 and 119 in the semicircular cavities 112 and 115 define a circular groove in a plane perpendicular to the longitudinal axis of the hand guard 100 and the barrel nut 200. Such an arrangement provides intimate contact of the hand guard with the smooth serrated rim 202 of the barrel nut 200 disposed therein thereby aiding in securing of the hand guard 100 to the barrel nut 200. In FIG. 3 is presented another exploded isometric view of the distal ends of the upper component 103 and the lower component 102 of hand guard 100. The distal end of the lower component 102 has parallel two tabs 120 and 121 extending upward from the opposite edges of lower component 102 such that the faces of the tabs are parallel, to the longitudinal axis of the hand guard 100. The tabs 120 and 121 are configured and dimensioned to mate with, fit into and maintain intimate contact with the corresponding slots 122 and 123 disposed within the distal end of upper component 103.

In certain embodiments when the hand guard 100 is assembled and is attached to firearm by means of the barrel nut 200 as described above, to the upper component 103 and lower component 102 are further secured to one another by a plurality of fixation means such as screws or bolts and threaded holes. In the embodiment herein illustrated the distal end of the upper component 103 and the distal end of lower component 102 are fixed by means of two or more distal end attachment bolts 130 that extend through two or more upper component distal apertures 131 (only one indicated for simplicity) and is fasten within two or more lower component distal end threaded apertures 132 (only one indicated for simplicity) that extend through the tabs 120 and 121. The proximal end of the upper component 103 and the proximal end of lower component 102 are fixed by means of two or more distal end attachment bolts 135 (only one indicated for simplicity) that extend through two or more upper component proximal apertures 136 (only one indicated for simplicity) and is fasten within two or more lower component distal end threaded apertures 137 (only one indicated for simplicity) that extend through the two flanges 104 and 105. When fixedly attached by such fastening means the upper component 103 and lower component 102 are secured to the barrel nut 200 and thus the hand guard 100 secured to firearm such that no further attachment point is required.

In certain embodiments the body of upper component 103 is configured to define a plurality of perforations or apertures extending there through as exemplified by upper component apertures 140, 141, 142 and 143 and the body of the lower component 102 is configured to define a plurality of perforations or apertures extending there through as exemplified by apertures 144, 145, and 146. Such apertures function to dissipate heat from the barrel of the firearm and also to reduce overall mass of the hand guard to aide in stability and accuracy of the firearm. In certain embodiments the body of upper component 103 is further configured to define an upper component rail 147 disposed on the apex of the upper component 103 extending along the longitudinal axis of the hand guard 100 and to which to which auxiliary firearm parts can be attached.

Figure 4:
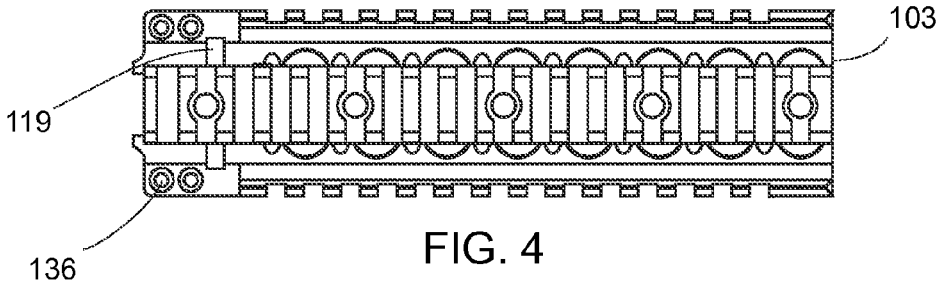
FIG. 4 is an orthogonal top view (depicting the outer surface) of the upper component of the hand guard of FIG. 1.
Figure 5:
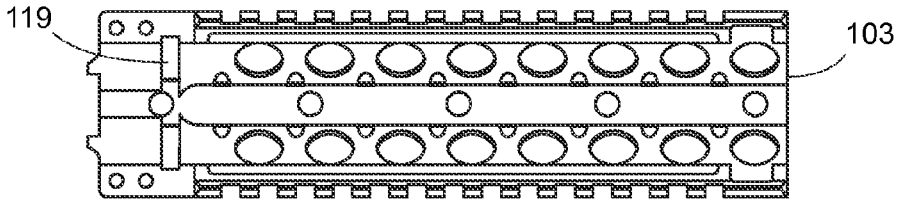
FIG. 5 is an orthogonal bottom view (depicting the inner surface) of the upper component of the hand guard of FIG. 1.
Figure 6:
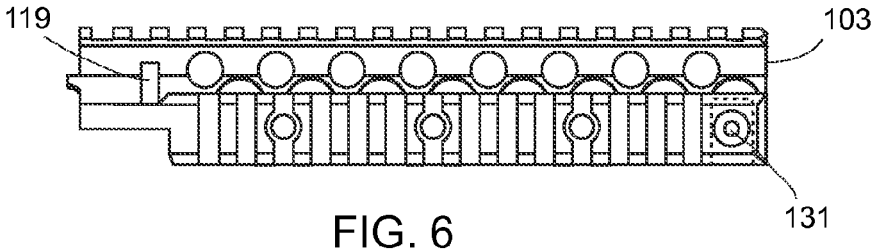
FIG. 6 is an orthogonal side view (depicting the outer surface) of the upper component of the hand guard of FIG. 1.
Figure 7:
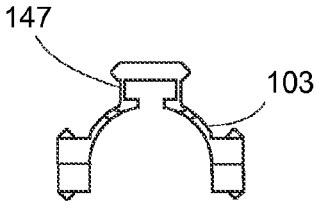
FIG. 7 is an orthogonal proximal end view of the upper component of the hand guard of FIG. 1.
Figure 8:
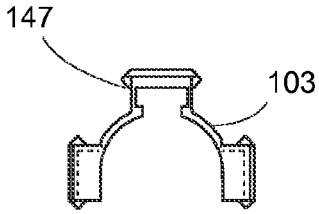
FIG. 8 is an orthogonal distal end view of the upper component of the hand guard of FIG. 1.

FIG. 4 depicts an orthogonal top view (depicting the outer surface) of the upper component 103 of the hand guard 100, FIG. 5 depicts an orthogonal bottom view (depicting the inner surface) of the upper component of the hand guard 100; FIG. 6 depicts an orthogonal side view (depicting the outer surface) of the upper component 103 of the hand guard 100; FIG. 7 depicts an orthogonal proximal end view of the upper component 103 of the hand guard 100; and FIG. 8 depicts an orthogonal distal end view of the upper component 103 of the hand guard 100.

Figure 9:
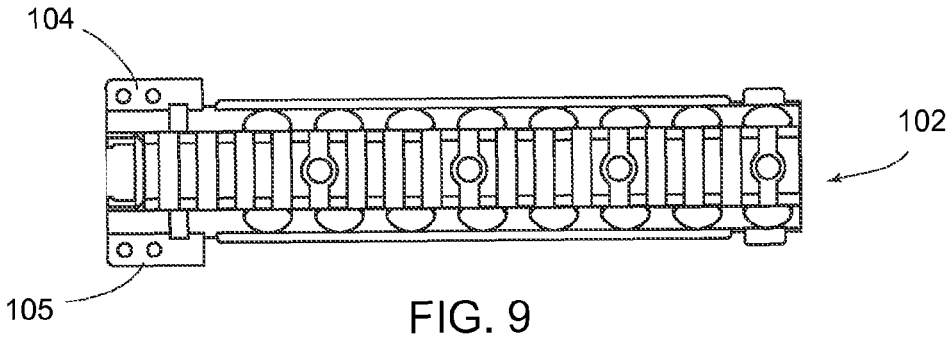
FIG. 9 is an orthogonal top view (depicting the outer surface) of the lower component of the hand guard of FIG. 1.
Figure 10:
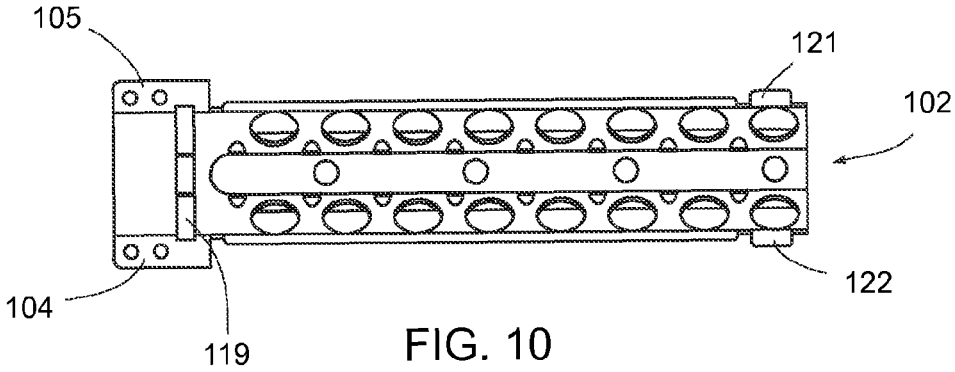
FIG. 10 is an orthogonal bottom view (depicting the inner surface) of the lower component of the hand guard of FIG. 1.
Figure 11:
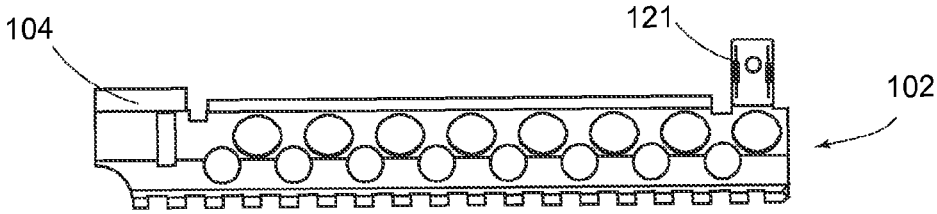
FIG. 11 is an orthogonal side view (depicting the outer surface) of the lower component of the hand guard of FIG. 1.
Figure 12:
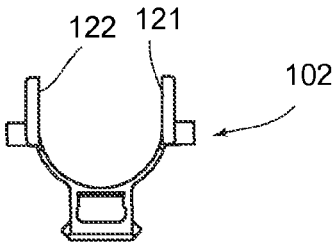
FIG. 12 is an orthogonal proximal end view of the lower component of the hand guard of FIG. 1.
Figure 13:
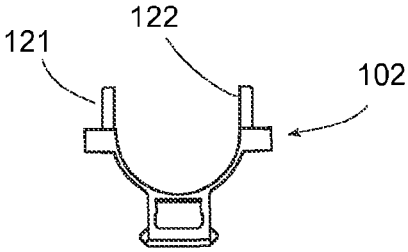
FIG. 13 is an orthogonal distal end view of the lower component of the hand guard of FIG. 1.

FIG. 9 depicts an orthogonal top view (depicting the outer surface) of the lower component 102 of the hand guard 100, FIG. 10 depicts an orthogonal bottom view (depicting the inner surface) of the upper component of the hand guard 100; FIG. 11 depicts an orthogonal side view (depicting the outer surface) of the lower component 102 of the hand guard 100; FIG. 12 depicts an orthogonal proximal end view of the lower component 102 of the hand guard 100; and FIG. 13 depicts an orthogonal distal end view of the lower component 102 of the hand guard 100.

Figure 14:
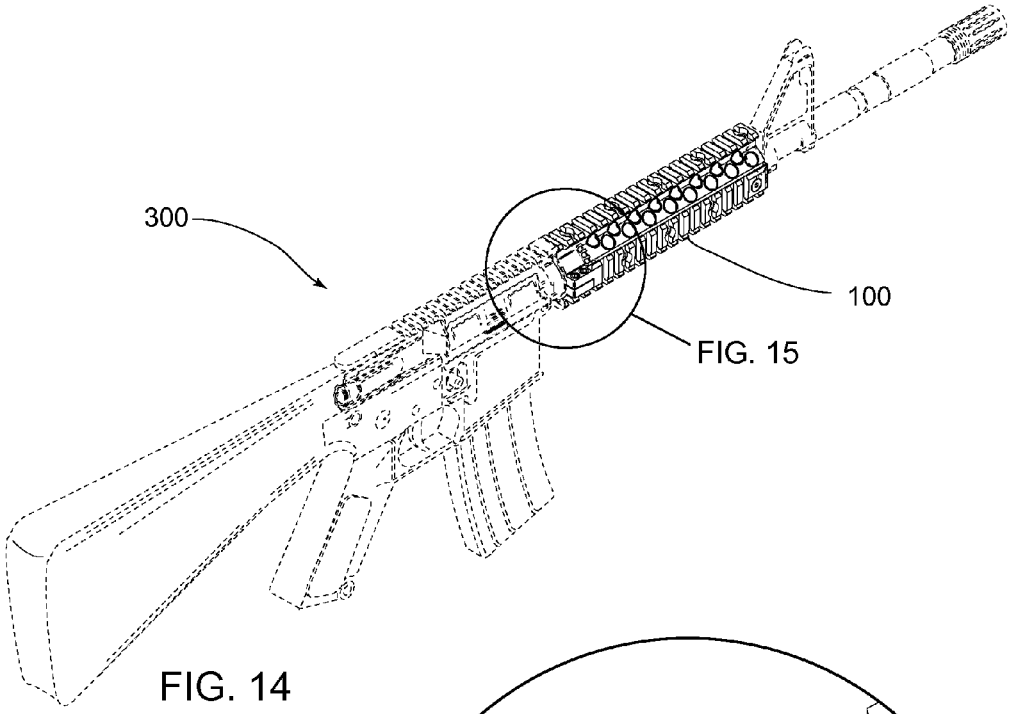
FIG. 14 is an isometric view of the hand guard of FIG. 1 attached to a firearm.
Figure 15:
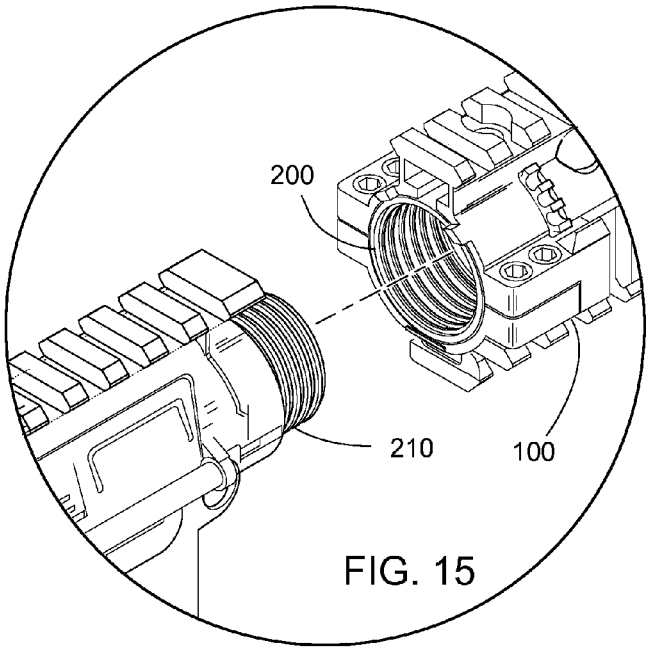
FIG. 15 is an exploded partial detail view of FIG. 14.

FIG. 14 depicts an isometric view of the hand guard 100 attached to an assembled firearm 300, while FIG. 15 depicts an exploded partial detail view of FIG. 14 illustrating the connection of the threaded firearm receiver 210 to the internally threaded barrel nut 200 which is secured within the hand guard 100.

Preferred materials of construction for components of embodiments extremity support apparatus of the present invention include, but are not limited to, metal such as aluminum or steel as well as combinations thereof. The most preferable material is aluminum or an aluminum alloy. Use of such metals decreases the likelihood of rusting and/or pitting of components and increases the ease of cleaning. Also use of such materials imparts a substantial durability and sturdiness to the apparatus with minimum weight.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

I claim:

1. A hand guard assembly reversibly attachable to a firearm, the firearm having a receiver, a barrel having a front site, a firearm barrel nut having a smooth circular outer surface and a serrated rim wherein the firearm barrel nut functions to affix the barrel to the receiver; wherein the hand guard assembly comprises:

an upper component comprising an upper component wall, an upper component proximal end, an upper component distal end, an upper component outer surface, an upper component inner surface and two parallel upper component edges; and a lower component comprising a lower component wall, a lower component proximal end, a lower component distal end, a lower component outer surface, a lower component inner surface, and two parallel lower component edges; wherein the upper and lower components are of equal length; and wherein the upper component inner surface at the upper component proximal end and the lower component inner surface at the lower component proximal end are each configured to define a smooth concave semicircular surface disposed between the two parallel upper component edges and the two parallel lower component edges respectively; and wherein each concave semicircular surface further comprises a groove configured to accommodate the serrated rim of a barrel nut on a firearm to which the hand guard assembly is attached, such that when the upper component and lower component are assembled and attached to the firearm barrel nut, the smooth concave semicircular surfaces provide intimate contact with the smooth circular outer surface of the barrel nut; wherein the proximal end of the upper component comprises two diametrically opposed L-shaped flanges and the proximal end of the lower component comprises two diametrically opposed flat flanges wherein the two upper component L-shaped flanges are configured to mate with and maintain intimate contact with the two lower component flat flanges and wherein the distal end of the lower component comprises two diametrically disposed parallel tabs extending upward from the two parallel lower component edges and the upper component comprises two diametrically disposed slots, wherein the lower component tabs are configured to mate with and maintain intimate contact with the upper component slots; and wherein the upper component and lower component are each dimensioned and configured such that, when the proximal ends are attached to the barrel nut and to one another, the hand guard assembly defines a generally tubular sleeve that encircles the firearm barrel along its longitudinal axis and extends from the barrel nut to a position just short of the firearm barrel front sight; and wherein the sole contact between the firearm and the hand guard assembly is the intimate contact between the barrel nut and the inner surfaces of the proximal ends of the upper and lower components.

2. The hand guard assembly of claim 1 comprising a means to attach and secure the upper component to the lower component, wherein the means to attach and secure comprises two upper component flanges disposed at the proximal end of the upper component and two lower component flanges disposed at the proximal end of the lower component, wherein one or more threaded apertures in each of the upper component flanges is mated to one or more threaded apertures in each of the lower component flanges and further comprising one or more attachment bolts mated to the threaded flange apertures.

3. The hand guard assembly of claim 1 comprising a means to attach and secure the lower component to the upper component, wherein the means to attach and secure comprises one or more threaded apertures in each of two lower component tabs disposed at the distal end of the lower component mated to one or more threaded apertures in each of two upper component slots disposed at the distal end of the upper component and further comprising one or more attachment bolts mated to the threaded tab and threaded slot apertures.

4. The hand guard assembly of claim 1 wherein the upper component comprises a plurality of upper component apertures extending though the upper component wall.

5. The hand guard assembly of claim 1 wherein the lower component comprises a plurality of lower component apertures extending though the lower component wall.

6. The hand guard assembly of claim 1 wherein the upper component comprises one or more upper component rails extending along the hand guard longitudinal axis and configured to provide a means for attachment of auxiliary firearm elements.

* * * * *